US011468811B2

(12) United States Patent
Zhu

(10) Patent No.: US 11,468,811 B2
(45) Date of Patent: Oct. 11, 2022

(54) DISPLAY PANEL CONTAINING GOA CIRCUITS ARRANGED BETWEEN ADJACENT ROWS OF PIXEL UNITS

(71) Applicant: SHENZHEN CHINA STAR OPTOELECTRONICS SEMICONDUCTOR DISPLAY TECHNOLOGY CO., LTD., Shenzhen (CN)

(72) Inventor: Jing Zhu, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 210 days.

(21) Appl. No.: 16/763,535

(22) PCT Filed: Apr. 22, 2020

(86) PCT No.: PCT/CN2020/086035
§ 371 (c)(1),
(2) Date: May 12, 2020

(87) PCT Pub. No.: WO2021/208120
PCT Pub. Date: Oct. 21, 2021

(65) Prior Publication Data

US 2022/0108645 A1 Apr. 7, 2022

(30) Foreign Application Priority Data

Apr. 13, 2020 (CN) ..... 202010285636.0

(51) Int. Cl.
*G09G 3/20* (2006.01)

(52) U.S. Cl.
CPC ..... *G09G 3/20* (2013.01); *G09G 2300/0408* (2013.01); *G09G 2310/0267* (2013.01);
(Continued)

(58) Field of Classification Search
None
See application file for complete search history.

(56) References Cited

U.S. PATENT DOCUMENTS

2005/0206585 A1* 9/2005 Stewart ..... G09G 3/2085 345/34
2017/0345373 A1 11/2017 Kang et al.
(Continued)

FOREIGN PATENT DOCUMENTS

CN 106023944 A 10/2016
CN 106098698 A 11/2016
CN 109637477 A 4/2019

*Primary Examiner* — Chad M Dicke
(74) *Attorney, Agent, or Firm* — PV IP PC; Wei Te Chung; Ude Lu

(57) ABSTRACT

The present application provides a display panel. A display area of the display panel includes pixel units, and non-display areas positioned on opposite sides of the display area are provided with a gate driver on array (GOA) bus unit. Two GOA circuit units are arranged side by side between two adjacent rows of the pixel units, and the two GOA circuit units arranged side by side are electrically connected to the pixel units. The GOA circuit units are electrically connected to the GOA bus unit through signal-connecting lines disposed in the display area, and wherein the two GOA circuit units arranged side by side share at least one of the signal-connecting lines. The present application is beneficial for increasing aperture ratio and transmittance of the pixel units.

20 Claims, 4 Drawing Sheets

(52) U.S. Cl.
CPC ..... *G09G 2310/0283* (2013.01); *G09G 2310/061* (2013.01); *G09G 2310/08* (2013.01)

(56) References Cited

U.S. PATENT DOCUMENTS

| | | | | |
|---|---|---|---|---|
| 2018/0218699 | A1* | 8/2018 | Du | G09G 3/3677 |
| 2019/0228695 | A1* | 7/2019 | Zou | G09G 3/20 |
| 2019/0237489 | A1* | 8/2019 | Matsukizono | H01L 27/3276 |

* cited by examiner

DISPLAY PANEL CONTAINING GOA CIRCUITS ARRANGED BETWEEN ADJACENT ROWS OF PIXEL UNITS

RELATED APPLICATIONS

This application is a National Phase of PCT Patent Application No. PCT/CN2020/086035 having international filing date of Apr. 22, 2020, which claims the benefit of priority of Chinese Patent Application No. 202010285636.0 filed on Apr. 13, 2020. The contents of the above applications are all incorporated by reference as if fully set forth herein in their entirety.

FIELD OF INVENTION

The present application relates to the field of display technology, in particular to a display panel.

BACKGROUND OF INVENTION

Gate driver on array (GOA) technology is a technology of directly manufacturing gate driver circuits (gate driver ICs) on an array substrate to replace an external silicon chip. At present, large-size, high-resolution display products and display products with extremely narrow borders have become market trends. Requirements of narrow widths of four sides of spliced screens are even more extreme. In addition, in order to seek lowest cost and best appearance, a technology of positioning the GOA in an active area (AA) is increasingly favored.

However, as resolutions become higher and pixel sizes become smaller, space for GOA layout becomes larger, and designing the GOA in the AA leads to a decrease in aperture ratio and seriously insufficient transmittance.

Therefore, the current technology has defects that need to be solved urgently.

Technical Problem

The present application provides a display panel, which can solve the problems of low aperture ratio and insufficient transmittance of the current narrow-frame display panel.

SUMMARY OF INVENTION

To solve the above problems, the technical solutions provided by this application are as follows:

The present application provides a display panel including, a display area and non-display areas positioned at a periphery of the display area, wherein the display area includes pixel units distributed in an array, and the non-display areas positioned on opposite sides of the display area are provided with a gate driver on array (GOA) bus unit.

Two GOA circuit units are arranged side by side between two adjacent rows of the pixel units, and the two GOA circuit units arranged side by side are electrically connected to the pixel units.

The GOA circuit units are electrically connected to the GOA bus unit through signal-connecting lines disposed in the display area, and the two GOA circuit units arranged side by side share at least one signal-connecting line.

In the display panel of the present application, the GOA bus unit includes at least one signal bus extending in a column direction, and each of the signal-connecting lines is correspondingly connected to one of the signal buses.

In the display panel of the present application, the signal buses include a first low-frequency clock signal bus and a second low-frequency clock signal bus, the GOA circuit unit is electrically connected to the first low-frequency clock signal bus and the second low-frequency clock signal bus through a first low-frequency clock signal-connecting line and a second low-frequency clock signal-connecting line, respectively; and wherein the two GOA circuit units arranged side by side share at least one of the first low-frequency clock signal-connecting line and the second low-frequency clock signal-connecting line.

In the display panel of the present application, the signal buses include a reset signal bus, and the GOA circuit unit is electrically connected to the reset signal bus through a reset signal-connecting line; and wherein the two GOA circuit units arranged side by side share the reset signal-connecting line.

In the display panel of the present application, the signal buses include a power signal bus, and the GOA circuit unit is electrically connected to the power signal bus through a power signal-connecting line, and wherein the two GOA circuit units arranged side by side share the power signal-connecting line.

In the display panel of the present application, the two GOA circuit units arranged side by side are electrically connected to the pixel units in the same row, alternately, the two GOA circuit units arranged side by side are electrically connected to two adjacent rows of the pixel units.

In the display panel of the present application, the two GOA circuit units arranged side by side are a first GOA circuit unit and a second GOA circuit unit, the GOA bus unit includes a first GOA bus unit and a second GOA bus unit, the first GOA circuit unit is electrically connected to the first GOA bus unit, and the second GOA circuit unit is electrically connected to the second GOA bus unit.

In the display panel of the present application, one of the first GOA bus unit and the second GOA bus unit includes the first low-frequency clock signal bus, and the other includes the second low-frequency clock signal bus, and one of the first GOA bus unit and the second GOA bus unit includes the reset signal bus, and the other includes the power signal bus.

In the display panel of the present application, a number of the signal buses in the first GOA bus unit and the second GOA bus unit are equal.

In the display panel of the present application, all the GOA circuit unit and the signal-connecting lines are positioned between the two adjacent rows of the pixel units, and the GOA circuit unit is electrically connected to the pixel unit through a scan line.

The present application further provides a display panel, including a display area and non-display areas positioned at a periphery of the display area, wherein the display area includes pixel units distributed in an array, and the non-display areas positioned on opposite sides of the display area are provided with a GOA bus unit.

The display panel is a bidirectional driving type display panel, two GOA circuit units are arranged side by side between two adjacent rows of the pixel units, and the two GOA circuit units arranged side by side are electrically connected to the pixel units.

The GOA circuit units are electrically connected to the GOA bus unit through signal-connecting lines disposed in the display area, and wherein the two GOA circuit units arranged side by side share at least one of the signal-connecting lines.

In the display panel of the present application, the GOA bus unit includes at least one signal bus extending in a column direction, and each of the signal-connecting lines is correspondingly connected to one of the signal buses.

In the display panel of the present application, the signal buses include a first low-frequency clock signal bus and a second low-frequency clock signal bus, the GOA circuit unit is electrically connected to the first low-frequency clock signal bus and the second low-frequency clock signal bus through a first low-frequency clock signal-connecting line and a second low-frequency clock signal-connecting line, respectively; and wherein the two GOA circuit units arranged side by side share at least one of the first low-frequency clock signal-connecting line and the second low-frequency clock signal-connecting line.

In the display panel of the present application, the signal buses include a reset signal bus, and the GOA circuit unit is electrically connected to the reset signal bus through a reset signal-connecting line, wherein the two GOA circuit units arranged side by side share the reset signal-connecting line.

In the display panel of the present application, the signal buses include a power signal bus, and the GOA circuit unit is electrically connected to the power signal bus through a power signal-connecting line, wherein the two GOA circuit units arranged side by side share the power signal-connecting line.

In the display panel of the present application, the two GOA circuit units arranged side by side are electrically connected to the pixel units in the same row, alternately, the two GOA circuit units arranged side by side are electrically connected to two adjacent rows of the pixel units.

In the display panel of the present application, the two GOA circuit units arranged side by side are a first GOA circuit unit and a second GOA circuit unit, the GOA bus unit includes a first GOA bus unit and a second GOA bus unit, the first GOA circuit unit is electrically connected to the first GOA bus unit, and the second GOA circuit unit is electrically connected to the second GOA bus unit.

In the display panel of the present application, one of the first GOA bus unit and the second GOA bus unit includes the first low-frequency clock signal bus, and the other includes the second low-frequency clock signal bus, and one of the first GOA bus unit and the second GOA bus unit includes the reset signal bus, and the other includes the power signal bus.

In the display panel of the present application, a number of the signal buses in the first GOA bus unit and the second GOA bus unit are equal.

In the display panel of the present application, all the GOA circuit unit and the signal-connecting lines are positioned between the two adjacent rows of the pixel units, and the GOA circuit unit is electrically connected to the pixel unit through a scan line.

Beneficial Effect

The beneficial effects of this application are:

In the display panel provided by the present application, two gate driver on array (GOA) circuit units are arranged side by side between adjacent two rows of pixel units, and the two GOA circuit units arranged side by side are electrically connected to the same row of the pixel units, and bidirectional driving is used to improve the drive capability of the display panel. In addition, the two GOA circuit units arranged side by side in this application share at least one of the signal-connecting lines to connect with the GOA bus unit. Therefore, a total number of signal-connecting lines in the display area is reduced and the saved space can be used to increase the aperture ratio of the pixel units, and the transmittance of the display panel can be improved.

DESCRIPTION OF DRAWINGS

In order to more clearly illustrate the technical solutions in the embodiments of the present invention, the following drawings described in the embodiments will be briefly introduced. It is obvious that the drawings described below are merely some embodiments of the present invention, other drawings can also be obtained by the person ordinary skilled in the field based on these drawings without doing any creative activity.

DETAILED DESCRIPTION OF PREFERRED EMBODIMENTS

Figure 1:
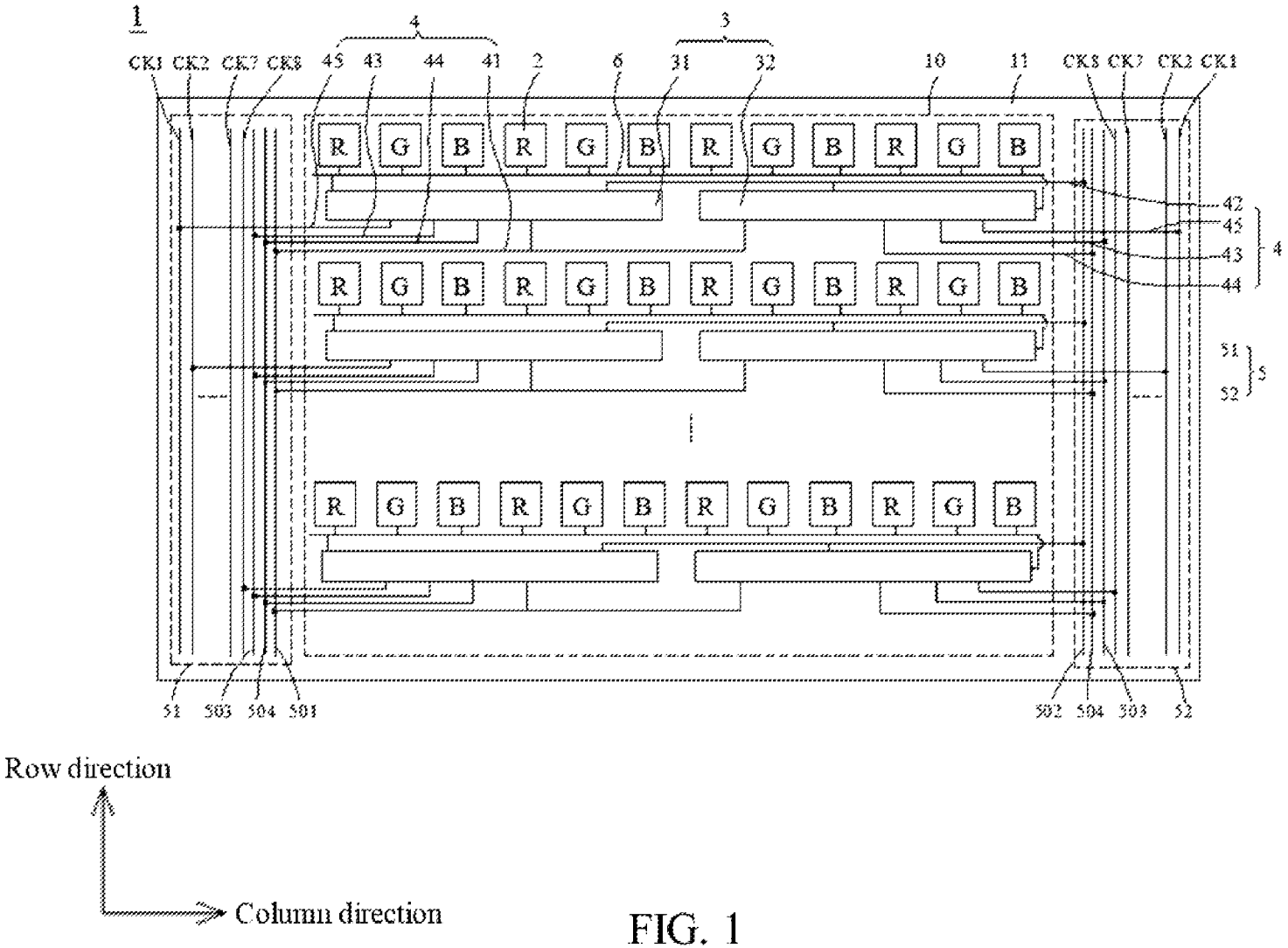
FIG. 1 is a schematic structural diagram of a display panel provided in embodiment 1 of the present application.

The technical solutions in the embodiments of the present application will be described clearly and completely with reference to the drawings in the embodiments of the present application. Obviously, the embodiments are only a part of the embodiments of the present application, but not all the embodiments. Based on these embodiments in the present application, all other embodiments obtained by those skilled in the art without making creative work fall within the protection scope of the present application.

In the description of this application, it should be understood that the orientation or positional relationship indicated by the terms "longitudinal", "lateral", "length", "width", "above", "below", "front", "back", "left", "right", "vertical", "horizontal", etc. are based on the orientation or positional relationship shown in the drawings, only for the convenience of describing the application and simplifying the description, not to indicate or imply the device or elements must have a specific orientation, be constructed and operated in a specific orientation, and therefore cannot be construed as limiting the present application. In addition, the terms "first" and "second" are used for descriptive purposes only, and cannot be understood as indicating or implying relative importance or implicitly indicating the number of technical features indicated. Thus, the features defined as "first" and "second" may explicitly or implicitly include one or more of the features. In the description of this application, the meaning of "plurality" is two or more, unless otherwise specifically limited. In this application, "I" means "or".

The present application may repeat reference numerals and/or reference letters in different examples. Such repetition is for simplicity and clarity and does not indicate the relationship and/or settings between the various embodiments.

The gate driver on array (GOA) display panel uses a GOA circuit to drive the display panel for display. With high-resolution display products and display products with extremely narrow borders becoming market trends, the GOA in AA type display panel came into being. The GOA circuit includes GOA bus unit (GOA bus line) and GOA circuit unit (GOA circuit). However, with a gradual increase of size and resolution of display panels, resistance-capacitance (RC) or impedance load of the GOA bus unit is large, which is not suitable for a display area. Generally, the GOA bus unit is set in a border area of the display panel, and the GOA circuit unit is set in the display area to achieve a narrow side width.

However, since the multi-stage GOA circuit unit is disposed between pixels in the display area, and each stage of the GOA circuit unit corresponds to driving a row of pixel units, a plurality of signal-connecting lines need to be disposed between pixels to transmit signals. As the resolution of the display panel increases, a number of GOA circuit units and signal-connecting lines also increases. Because the GOA circuit unit and the signal-connecting line also require a certain space, aperture ratio of the pixel unit is compressed, which further affects transmittance of the display panel.

Based on this, the present application provides a display panel to solve the above-mentioned defects.

Please refer to FIG. 1 to FIG. 4, the display panel of the present application includes a display area and non-display areas positioned at a periphery of the display area, the display area includes pixel units distributed in an array, and a GOA bus unit is provided in the non-display area. Two GOA circuit units are arranged side by side between two adjacent rows of the pixel units, and the two GOA circuit units arranged side by side are electrically connected to the pixel unit.

The display panel of the present application is a bidirectional driving type display panel, that is, it includes two sets of GOA circuits, and each set of GOA circuits includes N stage GOA circuit units, where N is a positive integer greater than zero. Each stage of the GOA circuit units corresponds to a scanning line.

Since the GOA bus unit includes a plurality of signal buses for transmitting different driving signals, each stage of the GOA circuit unit needs to be electrically connected to the plurality of signal buses in one-to-one correspondence with the plurality of signal-connecting lines. For example, the GOA bus unit includes a first low-frequency clock signal bus, a second low-frequency clock signal bus, a reset signal bus, a power signal bus, and a multi-stage high-frequency clock signal bus. The GOA circuit unit is electrically connected to the GOA bus unit through the signal-connecting lines. For example, between each GOA circuit unit and GOA bus unit, signal transmission is achieved through a first low-frequency clock signal-connecting line, a second low-frequency clock signal-connecting line, a reset signal-connecting line, and a power signal-connecting line, and a high-frequency clock signal-connecting line.

In this application, two GOA circuit units arranged side by side in the display area of the display panel share at least one of the signal-connecting lines. Therefore, the total number of signal-connecting lines in the display area is reduced, and the saved space can be used to increase the aperture ratio of the pixel unit, thereby improving the transmittance of the display panel.

The display panel of the present application will be described in detail below with specific embodiments.

Embodiment 1

Please refer to FIG. 1, which is a schematic structural diagram of a display panel according to embodiment 1 of the present application. The display panel 1 includes pixel units 2 arranged in an array in a display area 10, and a GOA circuit unit 3 and signal-connecting lines 4 between two adjacent rows of the pixel units 2. Each stage of the GOA circuit unit 3 is electrically connected to a row of the pixel units 2 through a scan line 6, and the GOA circuit unit 3 is used to provide a gate signal to the pixel unit 2 connected thereto.

Specifically, two GOA circuit units are arranged side by side in the row direction between the pixel units 2 in two adjacent rows, and the two GOA circuit units arranged side by side are electrically connected to the pixel units 2 in the same row, wherein the two GOA circuit units arranged side by side are respectively the same-stage GOA circuit unit in the two sets of GOA circuits, so the pixel units 2 in the same row can be driven at the same time.

Further, the two GOA circuit units arranged side by side are a first GOA circuit unit 31 and a second GOA circuit unit 32, the first GOA circuit unit 31 is electrically connected to a part of the pixel units 2 in a row of pixel units 2 (for example, to the left half pixel unit). The second GOA circuit unit 32 is electrically connected to the remaining pixel units 2 in the row of pixel units 2 (for example, to the right half pixel unit).

In this embodiment, the first GOA circuit units 31 in different rows are positioned in the same column, and the second GOA circuit units 32 in different rows are positioned in the same column. Of course, it is not limited to this.

Non-display areas 11 on opposite sides of the display area 10 are provided with GOA bus units 5. The GOA circuit unit 3 is electrically connected to the GOA bus units 5 through the signal-connecting lines 4. The GOA bus units 5 include at least one signal bus extending in the column direction, and one signal-connecting line 4 is correspondingly connected to the signal bus, wherein two GOA circuit units arranged side by side in the same row share at least one of the signal-connecting lines.

Specifically, the GOA bus units 5 include a first GOA bus unit 51 and a second GOA bus unit 52, and the first GOA bus unit 51 and the second GOA bus unit 52 are respectively positioned on opposite sides of the display area 10. The first GOA circuit unit 31 is electrically connected to the first GOA bus unit 51, and the second GOA circuit unit 32 is electrically connected to the second GOA bus unit 52.

The signal bus includes a first low-frequency clock signal bus 501, a second low-frequency clock signal bus 502, a reset signal bus 503, a power signal bus 504, and a plurality of high-frequency clock signal buses (CK), such as $CK_1$-$CK_n$, wherein n is a positive integer greater than or equal to 2. In this embodiment, n is equal to 8 as an example. Correspondingly, the signal-connecting lines 4 include a first low-frequency clock signal-connecting line 41, a second low-frequency clock signal-connecting line 42, a reset signal-connecting line 43, a power supply signal-connecting line 44, and a high-frequency clock signal-connecting line 45.

The first low-frequency clock signal bus 501 is used to transmit a first low-frequency clock signal (LC1), and the second low-frequency clock signal bus 502 is used to transmit a second low-frequency clock signal (LC2), the reset signal bus 503 is used to transmit a reset signal (RST), the power signal bus 504 is used to transmit a power signal (VSS), and the plurality of high-frequency clock signal buses (CK) are used to transmit a high-frequency clock signal.

In this embodiment, both the first GOA bus unit 51 and the second GOA bus unit 52 include the high-frequency clock signal bus (CK1 to CK8), and the reset signal bus 503 and the power signal bus 504. One of the first GOA bus unit 51 and the second GOA bus unit 52 includes the first low-frequency clock signal bus 501, and the other includes the second low-frequency clock signal bus 502. The number of the signal buses in the first GOA bus unit 51 and the second GOA bus unit 52 is equal.

Specifically, the first GOA circuit unit 31 is connected to the reset signal bus 503, the power signal bus 504, and the high-frequency clock signal bus (one of CK1 to CK8, such as CK1) through the first set of the reset signal-connecting line 43, the power supply signal-connecting line 44, and the high-frequency clock signal-connecting line 45, respectively, in a one-to-one correspondence. The second GOA circuit unit 32 is connected to the reset signal bus 503, the power signal bus 504, and the high-frequency clock signal bus (one of CK1 to CK8, such as CK1) through the second set of the reset signal-connecting line 43, the power supply signal-connecting line 44, and the high-frequency clock signal-connecting line 45, respectively, in a one-to-one correspondence.

The first GOA circuit unit 31 and the second GOA circuit unit 32 share at least one of the first low-frequency clock signal-connecting line 41 and the second low-frequency clock signal-connecting line 42.

In this embodiment, the first GOA circuit unit 31 and the second GOA circuit unit 32 share the first low-frequency clock signal-connecting line 41 and is electrically connected to the first low-frequency clock signal bus 501 through the first low-frequency clock signal-connecting line 41. Moreover, the first GOA circuit unit 31 and the second GOA circuit unit 32 share the second low-frequency clock signal-connecting line 42 and is electrically connected to the second low-frequency clock signal bus 502 through the second low-frequency clock signal-connecting line 42. That is, the first low-frequency clock signal bus 501 transmits the first low-frequency clock signal to the first GOA circuit unit 31 and the second GOA circuit unit 32 through the first low-frequency clock signal-connecting line 41 (LC1), respectively, and the second low-frequency clock signal bus 502 transmits a second low-frequency clock signal (LC2) to the first GOA circuit unit 31 and the second GOA circuit unit 32 through the second low-frequency clock signal-connecting line 42, respectively.

Of course, in other embodiments, the first GOA circuit unit 31 and the second GOA circuit unit 32 can share one of the first low-frequency clock signal-connecting line 41 and the second low-frequency clock signal-connecting line 42.

In the conventional display panel, since both the first GOA bus unit and the second GOA bus unit include a first low-frequency clock signal bus and a second low-frequency clock signal bus, and signal-connecting lines corresponding thereto, the border of the display panel is wider and the aperture ratio and the transmittance of the pixels are reduced. With the above design, this application reduces one signal bus in the first GOA bus unit and the second GOA bus unit on both sides of the display area, respectively, thereby reducing the border of the display panel and the number of signal-connecting lines in the display area. Furthermore, the aperture ratio and the transmittance of the pixel are increased.

In this embodiment, the same-stage GOA circuit units in the two sets of GOA circuits are correspondingly connected to the same scanning line, so that the two sets of GOA circuits drive the same row of pixel units together. Because of the increase in the resolution and size of the display panel, the signal attenuation is more serious. However, the use of bidirectional driving can solve this problem and improve the driving force of the display panel.

Embodiment 2

Figure 2:
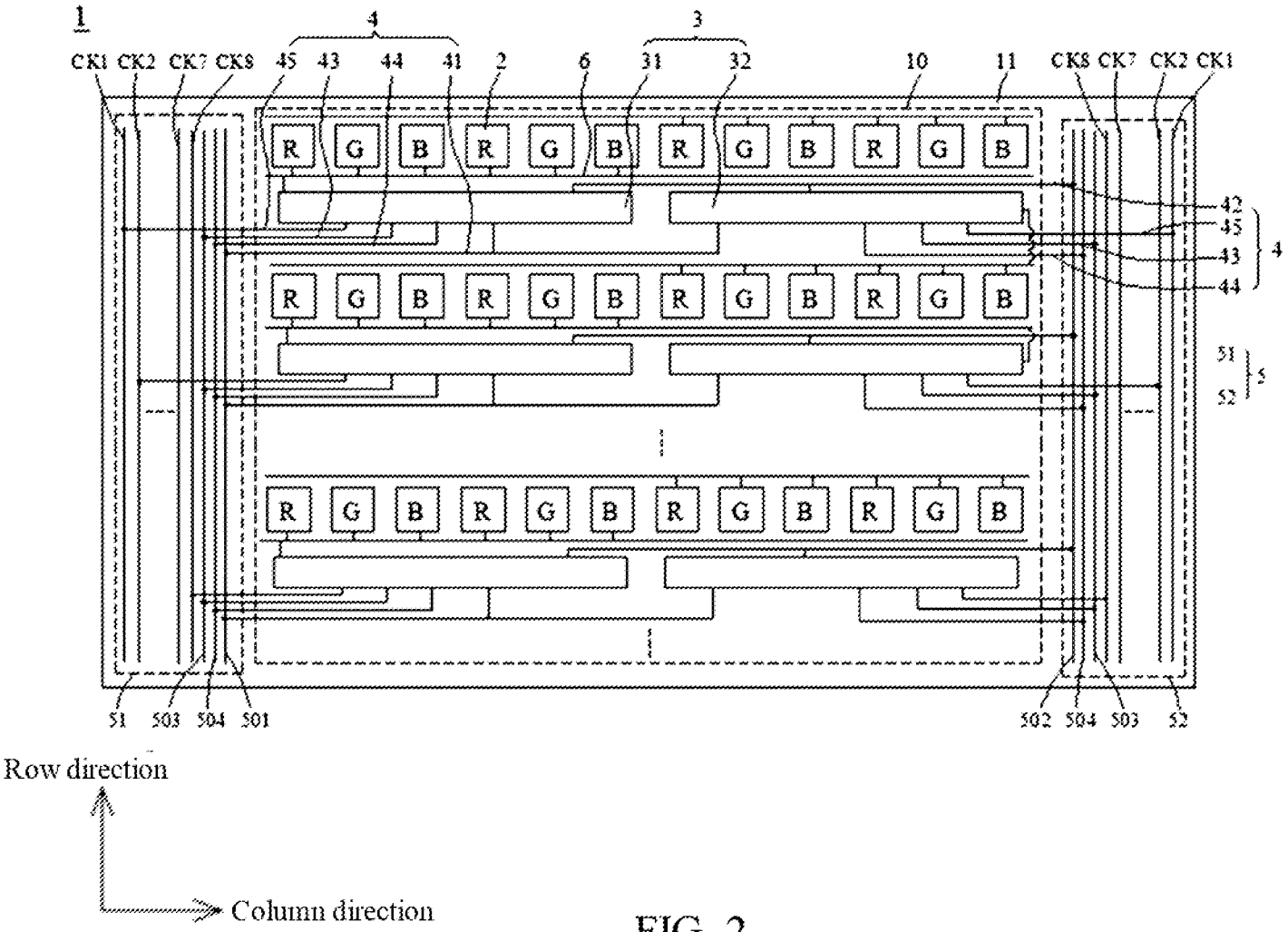
FIG. 2 is a schematic structural diagram of a display panel provided in embodiment 2 of the present application.

Please refer to FIG. 2, which is a schematic structural diagram of a display panel according to embodiment 2 of the present application. The structure of the display panel in this embodiment is the same as/similar to the structure of the display panel in the first embodiment above. The only difference is that two GOA circuit units 3 arranged side by side in the display panel of this embodiment are electrically connected to the pixel units 2 in two adjacent rows.

Specifically, the first GOA circuit unit 31 and the second GOA circuit unit 32 arranged side by side in the row direction differ by one stage in the number of stages. For example, if the first GOA circuit unit 31 is an N stage GOA circuit unit in the first set of GOA circuits, the second GOA circuit unit 32 is an N+1 stage GOA circuit unit in the second set of GOA circuits, wherein N is a positive integer greater than 0. Therefore, the first GOA circuit unit 31 and the second GOA circuit unit 32 arranged side by side in the same row are used to drive the pixel units 2 in adjacent rows, respectively.

Further, in the first GOA circuit unit 31 and the second GOA circuit unit 32 arranged side by side, the first GOA circuit unit 31 is electrically connected to a part of the pixel units 2 in a row of pixel units 2 (for example, to the pixel unit on the left half), and the second GOA circuit unit 32 is electrically connected to a part of the pixel units 2 (for example, to the pixel unit on the right half) in the previous/next row.

In this embodiment, two GOA circuit units 3 arranged side by side are electrically connected to two adjacent scanning lines, so that two sets of GOA circuits jointly drive pixel units in the same row. Because of the increase in the resolution and size of the display panel, the signal attenuation is more serious, and the use of bidirectional driving can solve this problem and improve the driving force of the display panel.

With the above design, this application reduces one signal bus in the first GOA bus unit and the second GOA bus unit on both sides of the display area, respectively, thereby reducing the border of the display panel and the number of signal-connecting lines in the display area. Furthermore, the aperture ratio and the transmittance of the pixel are increased.

Embodiment 3

Figure 3:
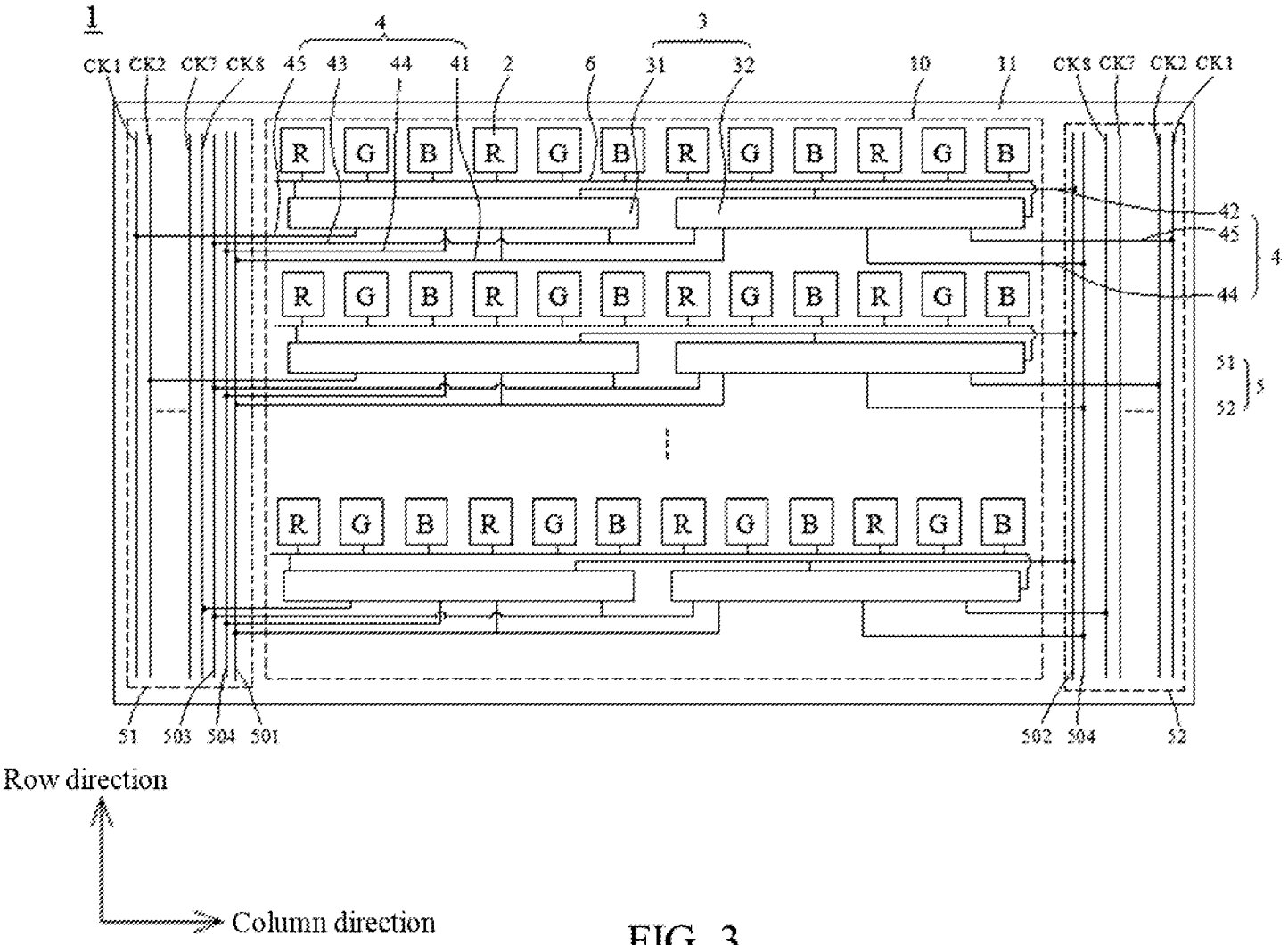
FIG. 3 is a schematic structural diagram of a display panel provided in embodiment 3 of the present application.

Please refer to FIG. 3, which is a schematic structural diagram of a display panel provided in embodiment 3 of the present application. The structure of the display panel in this embodiment is the same as/similar to the structure of the display panel in embodiment 1 described above. The only difference is that: two GOA circuit units 3 arranged side by side in the display panel of this embodiment share the reset signal-connecting line 43. In addition, one of the first GOA bus unit 51 and the second GOA bus unit 52 includes a reset signal bus 503, and the other does not include the reset signal bus 503.

That is, in this embodiment, the reset signal bus 503 transmits a reset signal (RST) to the first GOA circuit unit 31 and the second GOA circuit unit 32 through a common reset signal-connecting line 43, respectively. The first low-frequency clock signal bus 501 transmits the first low-frequency clock signal (LC1) to the first GOA circuit unit 31 and the second GOA circuit unit 32 through a common first low-frequency clock signal-connecting line 41, respectively. The second low-frequency clock signal bus 502 transmits a second low-frequency clock signal (LC2) to the first GOA circuit unit 31 and the second GOA circuit unit 32 through a common second low-frequency clock signal-connecting line 42, respectively.

The display panel of this embodiment reduces one signal bus in the first GOA bus unit and the second GOA bus unit, respectively, and reduces one reset signal bus in the first GOA bus unit or the second GOA bus unit so that the border of the display panel is reduced, and the number of signal-connecting lines in the display area is also reduced, thereby increasing the aperture ratio and transmittance of the pixels.

Embodiment 4

Figure 4:
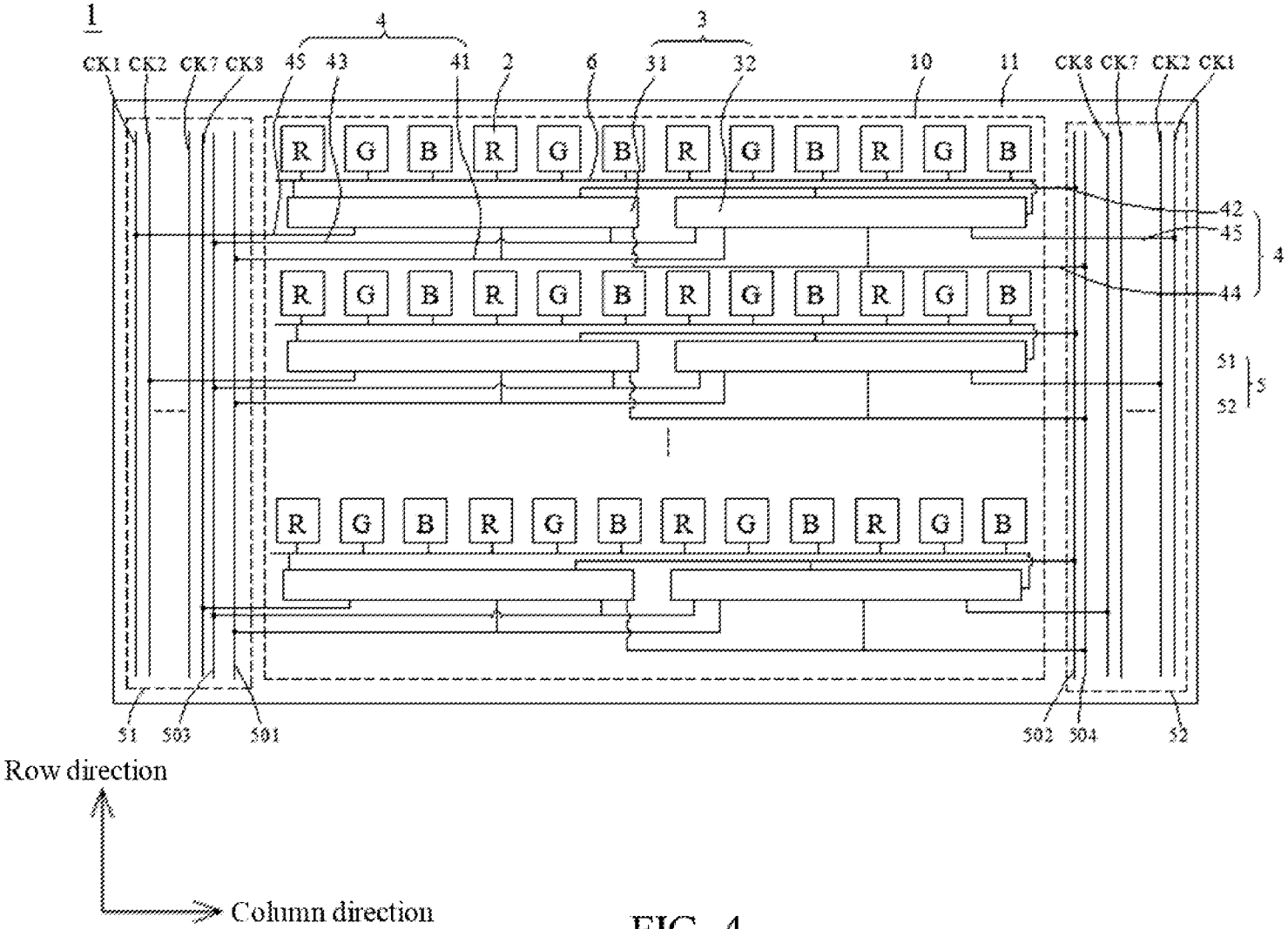
FIG. 4 is a schematic structural diagram of a display panel provided in embodiment 4 of the present application.

Please refer to FIG. 4, which is a schematic structural diagram of a display panel provided in embodiment 4 of the present application. The structure of the display panel in this embodiment is the same as/similar to the structure of the display panel in embodiment 3 described above. The only difference is that: two GOA circuit units 3 arranged side by side in the display panel of this embodiment share one power signal-connecting line 44. In addition, one of the first GOA bus unit 51 and the second GOA bus unit 52 includes a power signal bus 504, and the other does not include the power signal bus 504.

That is, in this embodiment, the power signal bus 504 transmits the power signal (VSS) to the first GOA circuit unit 31 and the second GOA circuit unit 32 through a common power signal-connecting line 44, respectively. The reset signal bus 503 transmits a reset signal (RST) to the first GOA circuit unit 31 and the second GOA circuit unit 32 through a common reset signal-connecting line 43, respectively. The first low-frequency clock signal bus 501 transmits the first low-frequency clock signal (LC1) to the first GOA circuit unit 31 and the second GOA circuit unit 32 through a common first low-frequency clock signal-connecting line 41, respectively. The second low-frequency clock signal bus 502 transmits a second low-frequency clock signal (LC2) to the first GOA circuit unit 31 and the second GOA circuit unit 32 through a common second low-frequency clock signal-connecting line 42, respectively.

Further, one of the first GOA bus unit 51 and the second GOA bus unit 52 includes the reset signal bus 503, and the other includes the power signal bus 504.

In the display panel of this embodiment, compared with the foregoing embodiment 3, one power signal bus is reduced in the first GOA bus unit or the second GOA bus unit. Therefore, the border of the display panel can be further reduced, and the number of signal-connecting lines in the display area is also reduced, thereby further increasing the aperture ratio and the transmittance of the pixel.

As described above, although the present application has been disclosed as preferred embodiments above, the above-preferred embodiments are not intended to limit the present application. Those of ordinary skill in the art can make various modifications and retouching without departing from the spirit and scope of the present application. Therefore, the protection scope of the present application is subject to the scope defined by the claims.

What is claimed is:

1. A display panel, comprising a display area and non-display areas positioned at a periphery of the display area, wherein the display area comprises pixel units distributed in an array, and the non-display areas positioned on opposite sides of the display area are provided with a gate driver on array (GOA) bus unit;

two GOA circuit units are arranged side by side between two adjacent rows of the pixel units, and the two GOA circuit units arranged side by side are electrically connected to the pixel units;

the GOA circuit units are electrically connected to the GOA bus unit through signal-connecting lines disposed in the display area; and wherein the two GOA circuit units arranged side by side share at least one of the signal-connecting lines.

2. The display panel according to claim 1, wherein the GOA bus unit comprises at least one signal bus extending in a column direction, and each of the signal-connecting lines is correspondingly connected to one of the signal buses.

3. The display panel according to claim 2, wherein the signal buses comprise a first low-frequency clock signal bus and a second low-frequency clock signal bus, the GOA circuit units are electrically connected to the first low-frequency clock signal bus and the second low-frequency clock signal bus through a first low-frequency clock signal-connecting line and a second low-frequency clock signal-connecting line, respectively, and wherein the two GOA circuit units arranged side by side share at least one of the first low-frequency clock signal-connecting line and the second low-frequency clock signal-connecting line.

4. The display panel according to claim 2, wherein the signal buses comprise a reset signal bus, and the GOA circuit units are electrically connected to the reset signal bus through a reset signal-connecting line; and wherein the two GOA circuit units arranged side by side share the reset signal-connecting line.

5. The display panel according to claim 2, wherein the signal buses comprise a power signal bus, and the GOA circuit unit is electrically connected to the power signal bus through a power signal-connecting line; and wherein the two GOA circuit units arranged side by side share the power signal-connecting line.

6. The display panel according to claim 1, wherein the two GOA circuit units arranged side by side are electrically connected to the pixel units in a same row, alternatively, the two GOA circuit units arranged side by side are electrically connected to two adjacent rows of the pixel units.

7. The display panel according to claim 1, wherein the two GOA circuit units arranged side by side are a first GOA circuit unit and a second GOA circuit unit, the GOA bus unit comprises a first GOA bus unit and a second GOA bus unit, the first GOA circuit unit is electrically connected to the first GOA bus unit, and the second GOA circuit unit is electrically connected to the second GOA bus unit.

8. The display panel according to claim 7, wherein one of the first GOA bus unit and the second GOA bus unit comprises the first low-frequency clock signal bus, the other comprises the second low-frequency clock signal bus, one of the first GOA bus unit and the second GOA bus unit comprises the reset signal bus, and the other comprises the power signal bus.

9. The display panel according to claim 8, wherein a number of the signal buses in the first GOA bus unit and the second GOA bus unit are equal.

10. The display panel according to claim 1, wherein all the GOA circuit units and the signal-connecting lines are positioned between the two adjacent rows of the pixel units, and the GOA circuit units are electrically connected to the pixel units through a scan line.

11. A display panel, comprising a display area and non-display areas positioned at a periphery of the display area, wherein the display area comprises pixel units distributed in an array, and the non-display areas positioned on opposite sides of the display area are provided with a GOA bus unit, the display panel is a bidirectional driving type display panel, two GOA circuit units are arranged side by side between two adjacent rows of the pixel units, and the two GOA circuit units arranged side by side are electrically connected to the pixel units;

the GOA circuit units are electrically connected to the GOA bus unit through signal-connecting lines disposed in the display area; and wherein the two GOA circuit units arranged side by side share at least one of the signal-connecting lines.

12. The display panel according to claim 11, wherein the GOA bus unit comprises at least one signal bus extending in a column direction, and each of the signal-connecting lines is correspondingly connected to one of the signal buses.

13. The display panel according to claim 12, wherein the signal buses comprise a first low-frequency clock signal bus and a second low-frequency clock signal bus, the GOA circuit units are electrically connected to the first low-frequency clock signal bus and the second low-frequency clock signal bus through a first low-frequency clock signal-connecting line and a second low-frequency clock signal-connecting line, respectively, and wherein the two GOA circuit units arranged side by side share at least one of the first low-frequency clock signal-connecting line and the second low-frequency clock signal-connecting line.

14. The display panel according to claim 12, wherein the signal buses comprise a reset signal bus, and the GOA circuit units are electrically connected to the reset signal bus through a reset signal-connecting line; and wherein the two GOA circuit units arranged side by side share the reset signal-connecting line.

15. The display panel according to claim 12, wherein the signal buses comprise a power signal bus, and the GOA circuit units are electrically connected to the power signal bus through a power signal-connecting line; and wherein the two GOA circuit units arranged side by side share the power signal-connecting line.

16. The display panel according to claim 11, wherein the two GOA circuit units arranged side by side are electrically connected to the pixel units in same row, alternatively, the two GOA circuit units arranged side by side are electrically connected to two adjacent rows of the pixel units.

17. The display panel according to claim 11, wherein the two GOA circuit units arranged side by side are a first GOA circuit unit and a second GOA circuit unit, the GOA bus unit comprises a first GOA bus unit and a second GOA bus unit, the first GOA circuit units are electrically connected to the first GOA bus unit, and the second GOA circuit units are electrically connected to the second GOA bus unit.

18. The display panel according to claim 17, wherein one of the first GOA bus unit and the second GOA bus unit comprises the first low-frequency clock signal bus, the other comprises the second low-frequency clock signal bus, one of the first GOA bus unit and the second GOA bus unit comprises the reset signal bus, and the other comprises the power signal bus.

19. The display panel according to claim 18, wherein a number of the signal buses in the first GOA bus unit and the second GOA bus unit are equal.

20. The display panel according to claim 11, wherein all the GOA circuit units and the signal-connecting lines are positioned between the two adjacent rows of the pixel units, and the GOA circuit units are electrically connected to the pixel unit through a scan line.

* * * * *